US006230417B1

(12) United States Patent
Smith

(10) Patent No.: US 6,230,417 B1
(45) Date of Patent: May 15, 2001

(54) LEVEL CROSSING ADJUSTING DEVICE

(76) Inventor: Peter John Coates Smith, 7 Gambles Lane, Woodmancote, Cheltenham, Gloucestershire GL52 4PU (GB)

( * ) Notice: Subject to any disclaimer, the term of this patent is extended or adjusted under 35 U.S.C. 154(b) by 0 days.

(21) Appl. No.: 09/134,941

(22) Filed: Aug. 17, 1998

(30) Foreign Application Priority Data

Aug. 16, 1997 (GB) ..... 9717330

(51) Int. Cl.[7] ..... E01B 29/13

(52) U.S. Cl. ..... 33/651; 33/1 Q; 33/287; 254/44

(58) Field of Search ..... 33/651, 651.1, 33/1 Q, 287, 338; 238/8; 14/77.1; 404/72, 73; 254/43, 44, 131

(56) References Cited

U.S. PATENT DOCUMENTS

| | | | | |
|---|---|---|---|---|
| 907,844 | * | 12/1908 | Miller | 254/44 |
| 1,379,801 | * | 5/1921 | Cole | 254/44 |
| 1,389,393 | * | 8/1921 | Stolle | 254/43 |
| 1,522,788 | * | 1/1925 | Moltz | 254/43 |
| 1,617,539 | * | 2/1927 | Newman | 254/44 |
| 1,637,459 | * | 8/1927 | Schwerin | 254/43 |
| 1,895,030 | * | 1/1933 | Elmore | 254/44 |
| 2,344,368 | * | 3/1944 | Rich | 254/43 |
| 2,449,232 | * | 9/1948 | Jones | 254/43 |
| 2,546,294 | | 3/1951 | Blomstrom . | |
| 2,636,716 | | 4/1953 | Fudge . | |
| 4,783,001 | * | 11/1988 | Subrick | 238/53 |
| 5,204,467 | * | 4/1993 | Kennel et al. | 238/8 |
| 5,478,050 | | 12/1995 | Ott . | |

* cited by examiner

*Primary Examiner*—Andrew H. Hirshfeld
*Assistant Examiner*—R. Alexander Smith
(74) *Attorney, Agent, or Firm*—Young & Thompson

(57) ABSTRACT

The gauge and cess panels (3, 4) of a level crossing creep apart lengthwise of the track (1, 2) and need closing up again from time to time. A device (5, 24) for this consists of a member (8, 26) that engages under or over a rail (1) and has a portion (10, 27) extending transversely to the rail carrying a cam (6) or screw (28) for engaging the end of a panel (3, 4). When the cam or screw is turned, the reaction from the panel (3, 4) jams the member (8, 26) on the rail (1), and further turning forces the panel lengthwise of the track. Another device for gauge panels is a two armed toggle (29) with a cam (31) at its pivot (30), the arms (29) being in a shallow V with their free ends (32) braced against the insides of the rails (1).

5 Claims, 3 Drawing Sheets

LEVEL CROSSING ADJUSTING DEVICE

Figure 1:
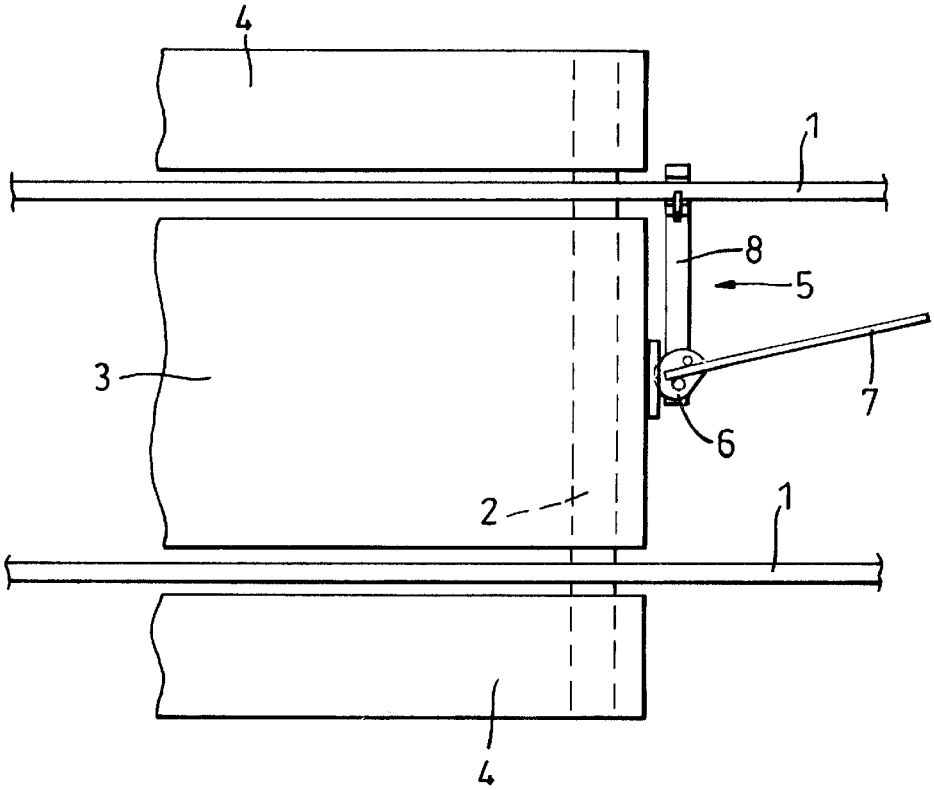

This invention concerns a level crossing adjusting device.

A railway level crossing has to give as smooth a path as possible to road traffic. The space between the rails, known as the gauge area, is often fitted with one or more panels over the sleepers and level with the top of the rails, leaving only narrow gaps on the insides of the rails for the wheel flanges of the trains. Outside the rails, the "cess areas" also have panels which can lead right up to the heads of the rails and create a smooth transition between the ordinary roadway and the gauge area.

The gauge and cess area panels have a tendency to creep longitudinally of the track, particularly when the crossing is skew. Each road vehicle disturbs them very slightly, and cumulatively this "creep" can produce quite a shift in a matter of weeks. If panels separate, the gaps between them are a hazard, particularly for bicycles. A large amount of effort and expense is therefore incurred by the track owners in shifting the panels back to eliminate such gaps.

It is the aim of this invention to provide a device which will make the job quick and easy, with no disruption to rail or road traffic.

According to the present invention, there is provided a level crossing adjusting device comprising a structure for co-operating with at least one rail of the track in a manner such that it is effectively rigid and fast to the track when a force lengthwise of the track is applied to it at a point offset from the rails, and an element carried by said structure at that point for engagement with the end of a level crossing panel and movable to shift such a panel in the opposite lengthwise direction of the track.

Said structure may simply be a bar with two abutments adjacent one end spaced to engage opposite sides of a rail with the bar generally transverse to the track. Preferably the bar will be adapted to engage under a rail, the abutments being spaced by marginally more than the bottom flange width of the rail, and conveniently there will be means for holding the bar up to the rail when the abutments are cooperating with the bottom flange of the rail. The bar will generally be cranked upwardly from the rail engaging end to said point so that the element is at the most appropriate level just below the plane tangential to the heads of the rails to act on the panel. No obstruction is then offered if the device has to be temporarily abandoned for passage of a train.

Alternatively, the structure may comprise two bars hinged end-to-end with said element at the hinge, the structure in use forming a shallow V pointing towards a gauge panel and the free ends of the bars abutting the insides of the rails.

Said element is conveniently a cam, and preferably is rotatable about a vertical axis. It can be rotatably mounted by a pin or bolt projecting beyond it and have an abutment projecting on the same side adjacent its periphery, the pin or bolt and the abutment providing means for levering the cam about the pin.

Another possible element is a screw threadedly engaged with said structure and having its axis generally lengthwise of the track when the device is fitted thereto.

Figure 2:
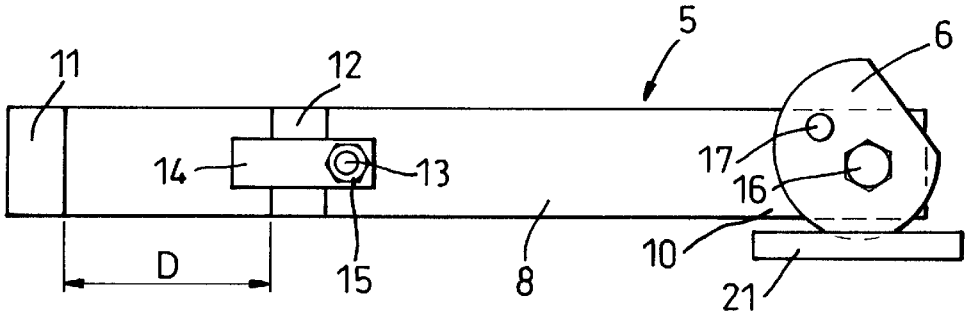
Figure 3:
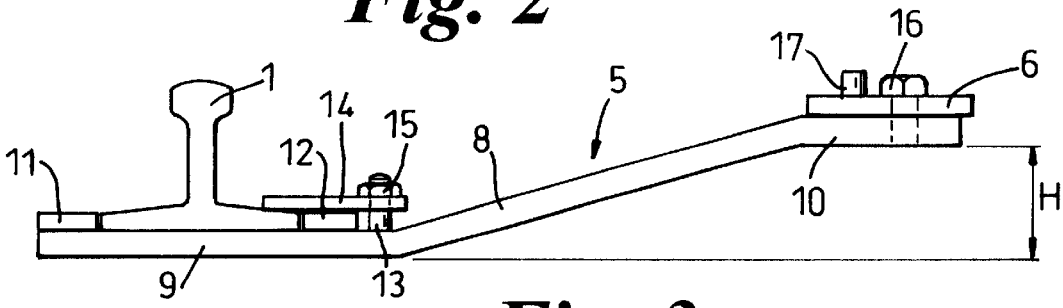
Figure 4:
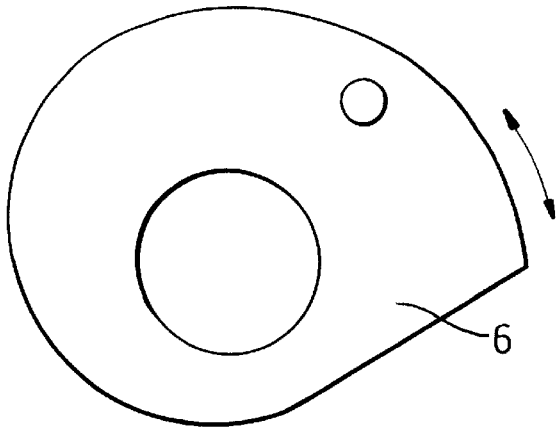
Figure 5:
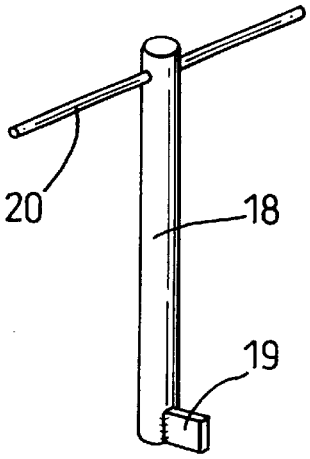
Figure 6:
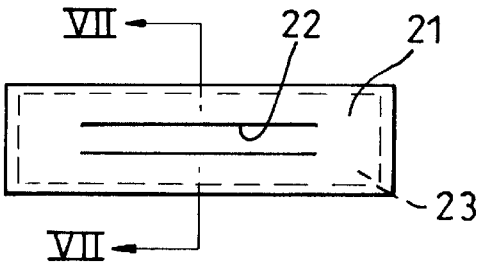
Figure 7:
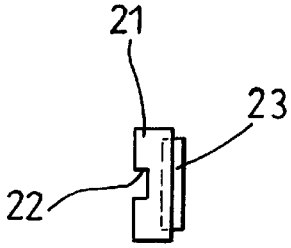

For a better understanding of the invention one embodiment will now be described, by way of example, with reference to the accompanying drawings, in which:

FIG. 1 is a diagrammatic plan view of part of a level crossing, showing a panel adjusting device in position, and being operated, FIG. 2 is a plan view of the device, to a larger scale, FIG. 3 is a side view of the device as positioned for use, FIG. 4 is a plan view of a cam forming part of the device, FIG. 5 shows a cam operating implement, FIG. 6 is a face view of a pressure plate used with the device, FIG. 7 is a cross section on the line VII—VII of FIG. 6.

Figure 8:
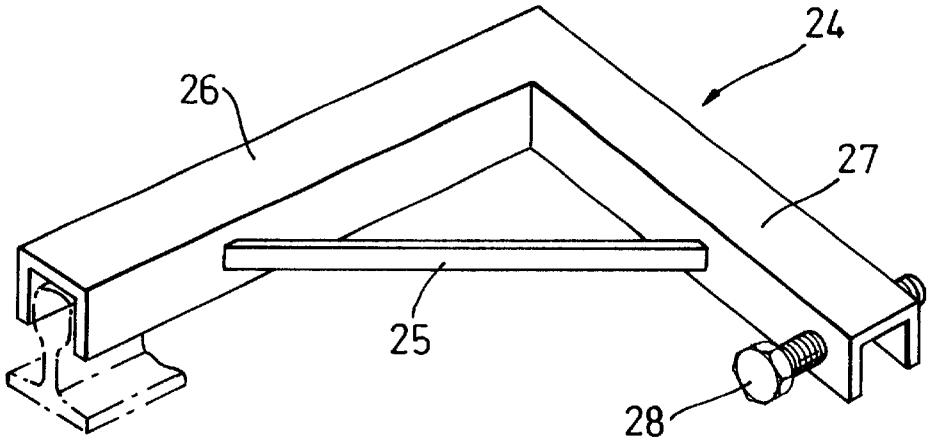
Figure 9:
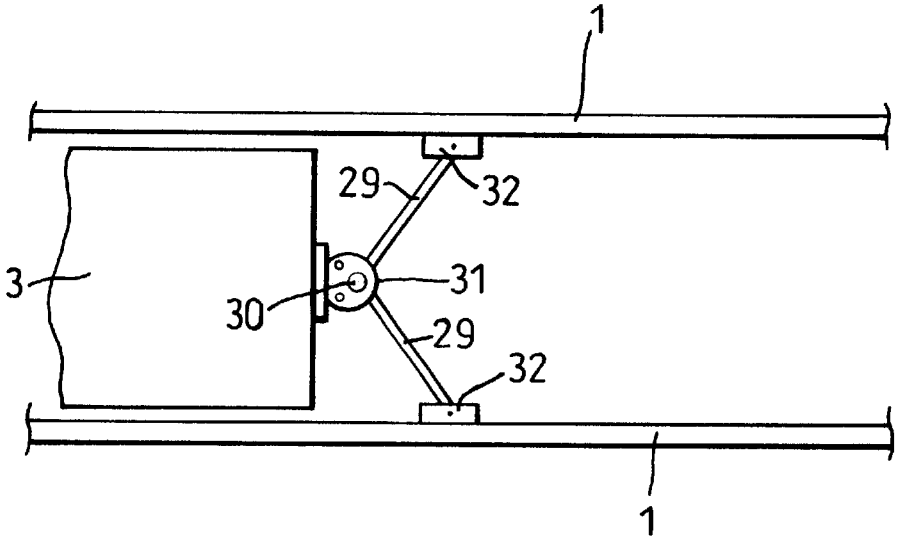

FIG. 8 is a diagrammatic perspective view of another panel adjusting device, and FIG. 9 is a diagrammatic plan view of a further panel adjusting device.

A railway track has two parallel rails 1 mounted on transverse sleepers 2, only one of which is shown in outline in FIG. 1. At a level crossing, the gauge area is substantially filled by panels 3 only one of which is shown; but they abut closely end to end over the length of the crossing. Outside the rails, in the cess areas, panels 4 provide a smooth transition from the roadway up to the rails 1 and the panels 3. Each rail 1 is generally of inverted T-Section, as seen in FIG. 3, with a thickened head on a vertical web and a wide bottom flange which sits on the chairs on the sleepers and which is engaged by rail clips to hold the rail down.

To adjust the panels 3 lengthwise of the track a device 5 is fitted to one of the rails and by use of a cam 6 and a crowbar 7 the panels can be wedged back into position. The cess panels 4 can be similarly adjusted but this description will concentrate on the gauge area panels.

The device is a flat bar 8 slightly cranked to form parallel end portions 9 and 10 with a spacing H between their planes, as seen in FIG. 3. The portion 9 has two short bars 11 and 12 welded across it in parallel on the same, upper side, the bar 11 being right at the end and the bar 12 being spaced from the bar 11 by a distance D marginally greater than the full width of the bottom flange of a rail. Adjacent the bar 12 there is an upstanding threaded stud 13 which carries a plate 14 captive by a nut 15, and this plate can be swung to a position where it overhangs the gap between the bars 11 and 12.

It will be seen that the bar 8 can be positioned transversely to the track with the portion 9 extending underneath the rail and the bars 11 and 12 embracing the bottom flange of the rail. It can be clamped in that position by the plate 14 engaging over the inner portion of the bottom flange of the rail. The clamping does not have to be tight: it serves merely to hold the bar 8 correctly with the end portion 10 almost up to the level of the head of the rail 1.

The stud 13 could be on the bar 12 and the plate 14 could be permanently captive and perhaps formed as a wedge which, as it is turned over the rail flange engages progressively more firmly. It is simply knocked into and out of engagement.

The cam 6 is mounted on the other end portion 10 by a bolt 16 about which it can rotate. Near the periphery of this cam is an upstanding stud 17. The crowbar 7 is inserted between the head of the bolt 16 and the stud 17 and can rotate the cam with very substantial leverage. The profile of the cam is such that the reaction force from the panel passes through the bolt 16, as shown in FIG. 4, and the cam does not tend to back off if the force on the crowbar is released.

To avoid working low down, another turning implement may be used, as shown in FIG. 5. A steel tube 18 has a radial lug 19 at one end and a T-handle 20 at the other end. Said one end locates over the bolt 16 while the lug 19 engages the stud 17, the handle 20 then being at a convenient height for the operator.

Instead of being applied directly to the end of the panel 3, a pressure distributing member 21 is normally interposed between the cam and the panel. This is a simple rectangular thick bar, as shown in FIGS. 6 and 7, with a groove 22 over its central portion on one side to receive the edge of the cam and a recess over all but its periphery on the other side to receive a stiffly resilient pad 23, of hard rubber for example. It will therefore stay in position even when there is no significant pressure applied by the cam, while the pad 23 avoids direct steel to concrete engagement.

It may not always be convenient to use one particular rail of the two. But the device is reversible and can be fitted to either rail, the cam 6 simply being rotated through 180°.

It will be understood that, instead of one cam (or bolt or other force exerting element) engaging the panel centrally, there could be two (or even more) such elements spaced along the bar to engage the panel simultaneously. Alternatively, for the gauge area panel, two shorter devices could be used, fitted to respective rails.

The advantage of the embodiment described is that, if a train is approaching and the job is not completed, it can be left in place (minus the crowbar) and the train allowed to pass. The job can then quickly be resumed.

However, if this is not considered important, it would be possible to use alternative simple structures. For example, as shown in FIG. 8 there could be an L-shaped member 24, possibly reinforced by an angled strut 25, with one arm 26 being an inverted channel member that can be dropped over the rail head and the other arm 27 carrying at its free end a cam, screw or other device 28 offering substantial mechanical advantage that will directly or indirectly engage the end of a panel. Indeed each arm could be a channel, each being equipped on the reverse side of the web at the free end with a mechanical advantage device. That could act on either end of a gauge panel array and on either end of a cess panel array whichever side of the track that may be.

Another structure suitable for adjusting gauge panels is shown in FIG. 9. This has two equal arms 29 pivoted together end to end and of a length such that they form a shallow V when arranged to span the track with the free ends bearing on the insides of the rails. The pivot 30 may be extended to form the pivot for a cam 31 similar to that described above. For use, the 'V' is arranged pointing towards the centre of the end of a gauge panel with the cam 31 in contact therewith. The cam is turned to project further towards the panel and the reaction forces the 'V' towards a shallower configuration, jamming the ends of the arms 29 even more firmly against the rails. These arms have non-conductive pads 32 at their ends to bear snugly against a substantial surface area, and to rest on the bottom flanges of the rail, and to maintain the rails electrically separate.

What is claimed is:

1. A device for adjusting level crossing panels in combination with a two rail track, each of said rails having a generally horizontal base flange, an upright web and a head, and a level crossing with associated panels, the surface of the crossing being substantially flush with tops of the rail heads, the device being for adjusting the panels longitudinally of the track and comprising a bar with an upper face at one end and two abutments proud of said face and spaced longitudinally on the bar with a gap therebetween, and an element with an abutment surface carried by the other end of the bar and adjustable with a mechanical advantage to advance said abutment surface in a direction transverse to the bar and parallel to and above the level of said upper face when said upper face is horizontal, wherein the device is arranged adjacent one end of the crossing with said upper face against an underside of one of the rails and with the abutments engaging opposite edges of the base flange of said one rail, so that the bar extends transversely of the track, and with the abutment surface of said element engaging an edge of one of said panels at said one end of the crossing.

2. A device as claimed in claim 1, wherein the bar carries a clamping member adjustable to overhang part of the gap between said abutments and closable towards said upper face.

3. A combination as claimed in claim 1, wherein the bar carries a clamping member adjustable to overhang part of the gap between said abutments and closable towards said upper surface, said member serving to clamp the bar to the base flange of said one rail.

4. A device for adjusting level crossing panels longitudinally of a railway track, the device comprising two bars hinged end-to-end and capable of assuming a shallow V-configuration, an element with an abutment surface carried at the vertex of the V and adjustable with a mechanical advantage to advance said abutment surface in the direction to which the V points, and electrically non-conductive pads at the ends of the bars remote from the hinged ends.

5. A device as claimed in claim 4, in combination with a two rail track each of, said rails having a generally horizontal base flange, an upright web and a head, and a level crossing with associated panels, the surface of the crossing being substantially flush with tops of the rail heads, the device being arranged adjacent one end of the crossing and between said rails with said pads co-operating with the webs of the rails and with the abutment surface of said element engaging an edge of one of said panels at said one end of the crossing.

* * * * *